United States Patent [19]

Babiak et al.

[11] 4,023,712

[45] May 17, 1977

[54] PORTABLE SPRAY CONTAINER DEVICE

[76] Inventors: Ihor Babiak; Ihor Klymciw, both of 215 Renforth Drive, Etobicoke, Ontario, Canada

[22] Filed: Jan. 27, 1976

[21] Appl. No.: 652,886

[52] U.S. Cl. ..... 222/175; 222/180; 222/182

[51] Int. Cl.[2] ..... B67D 5/64

[58] Field of Search ..... 222/175, 180, 179.5, 222/182; 239/152, 153, 154

[56] References Cited

UNITED STATES PATENTS 941,528 11/1909 Morgan ..... 222/175

3,450,313 6/1969 Jonas ..... 222/175 X

*Primary Examiner*—Allen N. Knowles

[57] ABSTRACT

A portable spray container device comprising a pressurized container having a spray outlet and containing a spray composition; a covering cap releasably attached to the pressurized container and covering the spray outlet; and a pendant means attached to the covering cap for suspending the portable spray container device from a suspending means. Also a method of inhibiting a person's appetite comprising spraying into the mouth of the person an effective amount of a taste spray which simulates a food spray.

10 Claims, 4 Drawing Figures

PORTABLE SPRAY CONTAINER DEVICE

This invention relates to a portable spray container device for spraying sprayable compositions; and further relates to a method of inhibiting a person's appetite thru the use of a taste spray which simulates food tastes.

Many sprayable compositions are known in the art. For example:

U.S. Pat. No. 2,203,764 describes a fumigant and a fumigant combined with a warning agent for hydrocyric gas, which is used as a fumigant; U.S. Pat. No. 3,755,558 describes a sprayable pharmaceutical composition for topical administration which, upon being sprayed forms an adherent, pharmaceutically useful, medicated film at a desired external sight that gradually releases an effective amount of a topically and externally useful drug from the adherent film applied to the external sight over a pre-determined period of time; U.S. Pat. No. 3,590,118 describes a long lasting insect repellent film for the skin and other substrates which can be sprayed onto the skin and other substrates.

Numerous other sprays are known in the art. For example, deodorants, perfumes, mouth sprays, etc.

Further it is known in the art that certain spray container devices can be used. One sees this in numerous places, on the drug store shelf, or supermarket shelf, etc.

These spray container devices usually have the above described spray compositions in them.

SUMMARY OF THE INVENTION

An object of this invention is to provide a portable spray container device which may be conveniently suspended from a portion of a person's body. The portable spray container device contains any one of a number of spray compositions.

A further object of this invention is to provide a portable spray container device containing a taste spray which simulates food tasts and will alleviate hunger in a person.

Other objects will be hereinafter apparent.

The invention is a portable spray container device comprising:

a. a pressurized container having a spray outlet and containing a spray composition;

b. a covering cap releasably attached to the pressurized container and covering the spray outlet;

c. a pendant means attached to the covering cap for suspending the portable spray container from a suspending means.

In the accompanying drawing forming part of this specification, similar characters of reference indicate corresponding parts in all the views.

Figure 1:
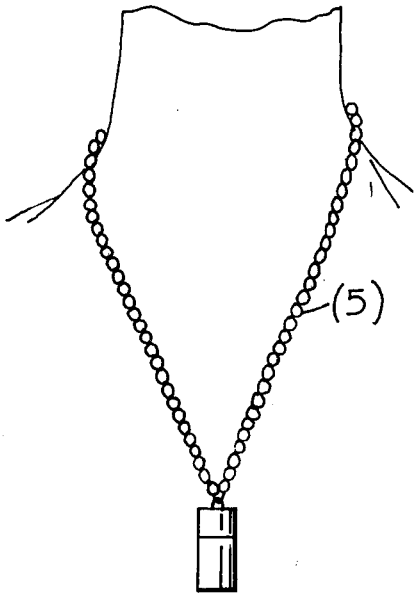
FIG. 1 is a plan view of the portable spray container device in use.
Figure 2:
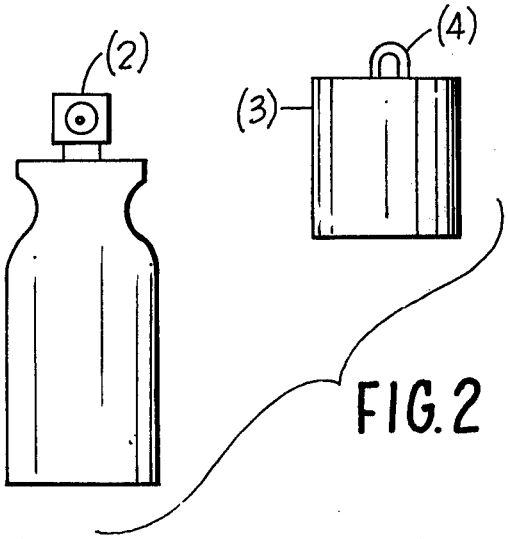
FIG. 2 is a plan view of the portable spray container device.
Figure 3:
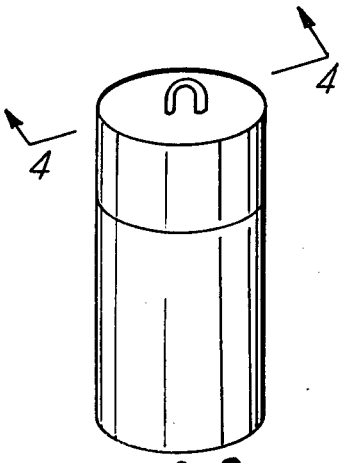
FIG. 3 is a perspective view of the portable spray container device.
Figure 4:
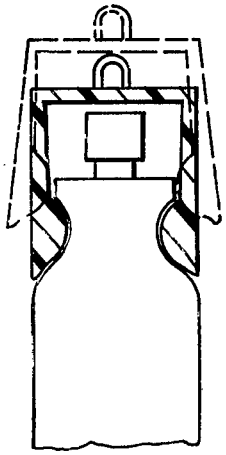
FIG. 4 is a sectional view of the portable spray container device taken along line 4—4 of FIG. 3.

The portable spray container device is comprised of a pressurized container (1). This invention contemplates the use of any type pressurized container commonly in use and known by those skilled in the art.

The pressurized container is further comprised of a spray outlet (2). This invention contemplates the use of any type spray outlet commonly known in the art. The pressurized container is further comprised of a spray composition contained within the pressurized container.

This invention contemplates the use of any type spray composition known in the art. For example:

a fumigant
a pharmaceutical composition
a deodorant
a perfume
an insect repellent
a mouth spray A particularly preferred sprayable composition is a sprayable composition which simulates the tastes of food. This sprayable composition when sprayed in the mouth of a person will tend to alleviate his hunger. However, as previously mentioned any type sprayable composition is contemplated by this invention.

The portable spray container device may further contain within the pressurized container a "Freon" type material i.e., a propellant, to expel the sprayable composition within the pressurized container.

The portable spray container device is further comprised of a covering cap (3) releasably attached to the pressurized container (1) and covering the spray outlet (2). Any type covering cap is contemplated by this invention. Such covering caps are commonly known in the art.

The covering cap has attached to it a pendant means for suspending the portable spray container device from a suspending means (5). This invention contemplates the use of any type pendant means, however it is preferred that the pendant means be a wire loop attached to the covering cap. The suspending means may be any common type suspending means, particulary preferred is a necklace chain worn around the neck of a person. However this invention contemplates the use of a wrist chain, etc., which may be conveniently attached to a person's neck, arm, etc. The positioning of the suspending means is determined somewhat by the type of spray contained within the portable spray container device.

Another aspect of this invention is a method of inhibiting a person's appetite comprising spraying into the mouth of the person an effective amount of a taste spray which simulates food taste. The method of this invention may be carried out by the use of this portable spray container device, however it is not to be so limited. Any type spray container device or means for spraying the taste spray into the mouth is contemplated.

The invention is capable of numerous forms and various applications without departing from the essential features herein disclosed. It is therefore intended and desired that the embodiments shown herein shall be deemed illustrative and not restrictive and that the patents shall cover all patentable novelty herein set forth, reference being had to the following claims rather than to the specific descriptions and showings herein to indicate the scope of this invention.

Having thus described the invention, what we claim as new is:

1. A portable spray container device comprising:

a. a pressurized container having a spray outlet and containing a spray composition and a propellant;

b. a covering cap releasably attached to the pressurized container and covering the spray outlet to prevent accidental discharge of the pressurized container; and c. a pendant means attached to the covering cap for suspending the portable spray container from a suspending means;

whereby when the pressurized container is pulled, the covering cap is released from the pressurized container uncovering the spray outlet for use and the cap remains suspended from the suspending means thereby preventing loss of the cap.

2. The portable spray container device of claim 1, wherein the pendant means is a wire loop attached to the covering cap.

3. The portable spray container device of claim 1, wherein the suspending means is a necklace chain.

4. The portable spray container device of claim 1, wherein the propellant is a "Freon" type material.

5. The portable spray container device of claim 1, wherein the spray composition is a fumigant.

6. The portable spray container device of claim 1, wherein the spray composition is a sprayable pharmaceutical composition for topical administration.

7. The portable spray container device of claim 1, wherein the spray composition is a deodorant.

8. The portable spray container device of claim 1, wherein the spray composition is a perfume.

9. The portable spray container device of claim 1, wherein the spray composition is an insect repellent.

10. The portable spray container device of claim 1, wherein the spray composition is a taste spray to simulate food tastes for alleviating hunger.

* * * * *